US009453508B2

(12) United States Patent
Suzuki et al.

(10) Patent No.: US 9,453,508 B2
(45) Date of Patent: Sep. 27, 2016

(54) ELECTRIC OIL PUMP AND HYDRAULIC PRESSURE SUPPLY DEVICE

(71) Applicant: ASMO CO., LTD., Kosai-shi, Shizuoka-ken (JP)

(72) Inventors: Mototsugu Suzuki, Kosai (JP); Masaru Irie, Shizuoka (JP)

(73) Assignee: Asmo Co., LTD., Kosai-shi (JP)

( * ) Notice: Subject to any disclaimer, the term of this patent is extended or adjusted under 35 U.S.C. 154(b) by 270 days.

(21) Appl. No.: 14/185,159

(22) Filed: Feb. 20, 2014

(65) Prior Publication Data

US 2014/0241917 A1 Aug. 28, 2014

(30) Foreign Application Priority Data

Feb. 25, 2013 (JP) ..... 2013-034752
Mar. 6, 2013 (JP) ..... 2013-044444
Nov. 6, 2013 (JP) ..... 2013-230206

(51) Int. Cl.
*F04C 15/06* (2006.01)
*F04C 13/00* (2006.01)
(Continued)

(52) U.S. Cl.
CPC ..... *F04C 15/06* (2013.01); *F04C 2/102* (2013.01); *F04C 11/008* (2013.01); *F04C 13/001* (2013.01); *F04C 15/0096* (2013.01); *F04C 2210/206* (2013.01)

(58) Field of Classification Search
CPC ..... F04C 13/001; F04C 13/002; F04C 2210/206; F04C 15/06; F04C 11/008; F04C 2/102; F04C 15/0096; F01M 2001/0215
USPC ..... 417/410.1, 410.3, 410.4
See application file for complete search history.

(56) References Cited

U.S. PATENT DOCUMENTS 2,405,061 A * 7/1946 Shaw ..... F04C 2/102 418/132
4,875,551 A * 10/1989 Lulich ..... F01M 5/025 123/179.1

(Continued)

FOREIGN PATENT DOCUMENTS

JP 2005188393 A 7/2005
JP 2008215088 A 9/2008

(Continued)

OTHER PUBLICATIONS

Japanese Office Action for JP App. No. JP2013-034752 dated Jun. 28, 2016.

*Primary Examiner* — Devon Kramer
*Assistant Examiner* — Chirag Jariwala
(74) *Attorney, Agent, or Firm* — Michael A. Bondi; Moss & Barnett

(57) ABSTRACT

An electric oil pump is coupled to a pump receptacle including an oil inflow passage and an oil outflow passage. The electric oil pump includes a motor, a pump rotor, a housing, and a check valve. The housing accommodates the motor and the pump rotor. The housing closes an opening of the pump receptacle and includes at least a fitted portion fitted into the pump receptacle. An oil compartment is formed between the pump receptacle and the housing. Oil flows into the oil compartment from the oil inflow passage when the pump rotor is rotated. The fitted portion is partially immersed in the oil collected in the oil compartment. The housing includes a suction port and a discharge port. A check valve, located in the housing, limits reversed flow of the oil from the oil compartment to the oil inflow passage.

14 Claims, 5 Drawing Sheets

(51) Int. Cl.

| | |
|---|---|
| ***F04C 2/10*** | (2006.01) |
| ***F04C 11/00*** | (2006.01) |
| ***F04C 15/00*** | (2006.01) |

(56) References Cited

U.S. PATENT DOCUMENTS

| | | | | |
|---|---|---|---|---|
| 6,783,340 | B2 * | 8/2004 | Dong | F04C 2/104 418/132 |
| 6,796,778 | B2 * | 9/2004 | Utsumi | F02M 55/00 123/446 |
| 7,156,623 | B2 * | 1/2007 | Sakakibara | F04C 2/102 417/310 |
| 7,278,841 | B2 * | 10/2007 | Phillips | F04C 2/086 418/132 |
| 2010/0319665 | A1 * | 12/2010 | Li | F01M 1/04 123/573 |
| 2012/0128513 | A1 | 5/2012 | Sakata | |
| 2014/0054991 | A1 * | 2/2014 | Hyodo | F04C 2/18 310/71 |
| 2014/0169995 | A1 * | 6/2014 | Sugihara | F04B 17/03 417/410.1 |

FOREIGN PATENT DOCUMENTS

| | | |
|---|---|---|
| JP | 2011-094553 | 5/2011 |
| JP | 2012-097582 | 5/2012 |
| JP | 2012-097583 | 5/2012 |
| JP | 2012-097584 | 5/2012 |
| JP | 2012-193702 | 10/2012 |
| JP | 2013-064356 | 4/2013 |
| JP | 2013-115860 | 6/2013 |
| JP | 2013-122234 | 6/2013 |
| JP | 2013-150403 | 8/2013 |
| JP | 2013-160079 | 8/2013 |
| JP | 2013-183603 | 9/2013 |
| JP | 2013-201804 | 10/2013 |

* cited by examiner

ELECTRIC OIL PUMP AND HYDRAULIC PRESSURE SUPPLY DEVICE

BACKGROUND OF THE INVENTION

The present invention relates to an electric oil pump and a hydraulic pressure supply device that are arranged in, for example, a transmission of a vehicle.

Japanese Laid-Open Patent Publication No. 2011-94553 describes an example of an electric oil pump that includes a motor, a pump rotor driven and rotated by the motor, and a housing accommodating the motor and the pump rotor. The housing is partially fitted into a pump receptacle of a vehicle transmission so that the housing closes the pump receptacle. The housing includes an inlet and an outlet through which oil is drawn in and discharged when the pump rotor rotates. As the pump rotor rotates, oil is drawn into the oil pump through the inlet from an oil inflow passage in the pump receptacle. Further, oil is discharged from the oil pump through the outlet and into an oil outflow passage in the pump receptacle.

In such an electric oil motor, the motor, especially, a stator of the motor is easily heated. When heat is transmitted from the stator to the pump rotor, the pumping properties may be affected. Thus, it is desirable that heat radiation capacity of the electric oil pump be increased.

SUMMARY OF THE INVENTION

It is an object of the present invention to provide an electric oil pump and a hydraulic pressure supply device having an increased heat radiation capacity.

To achieve the above object, one aspect of the present invention provides an electric oil pump coupled to a pump receptacle including an oil inflow passage and an oil outflow passage. The electronic oil pump includes a motor, a pump rotor rotated when the motor is driven, and a housing that accommodates the motor and the pump rotor. The housing is formed to close the pump receptacle and includes at least a fitted portion fitted into the pump receptacle. The housing includes an outer surface, and the pump receptacle includes a wall surface. An oil compartment is formed between the wall surface of the pump receptacle and the outer surface of the housing. Oil flows into the oil compartment from the oil inflow passage when the pump rotor is rotated. The fitted portion is partially immersed in the oil collected in the oil compartment. The housing includes a suction port through which oil is drawn into the housing from the oil compartment when the pump rotor rotates, and a discharge port through which oil is discharged to the oil outflow passage when the pump rotor rotates. A check valve is located in the housing. The check valve limits reversed flow of the oil from the oil compartment to the oil inflow passage.

A further aspect of the present invention is a hydraulic pressure supply device provided with a pump receptacle including an oil inflow passage and an oil outflow passage. An electric oil pump is coupled to the pump receptacle. The electronic oil pump includes a motor, a pump rotor rotated when the motor is driven, and a housing that accommodates the motor and the pump rotor. The housing is formed to close the pump receptacle and includes at least a fitted portion fitted into the pump receptacle. The housing includes an outer surface, and the pump receptacle includes a wall surface. An oil compartment is formed between the wall surface of the pump receptacle and the outer surface of the housing. Oil flows into the oil compartment from the oil inflow passage when the pump rotor is rotated. The fitted portion is partially immersed in the oil collected in the oil compartment. The housing includes a suction port through which oil is drawn into the housing from the oil compartment when the pump rotor of the electric oil pump rotates, and a discharge port through which oil is discharged to the oil outflow passage when the pump rotor rotates. A check valve is located in an oil flow passage including the oil inflow passage and the oil outflow passage. The check valve limits reversed flow of the oil from the oil compartment to the oil inflow passage.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

One embodiment of a hydraulic pressure supply device including an electric oil pump will now be described.

Figure 1:
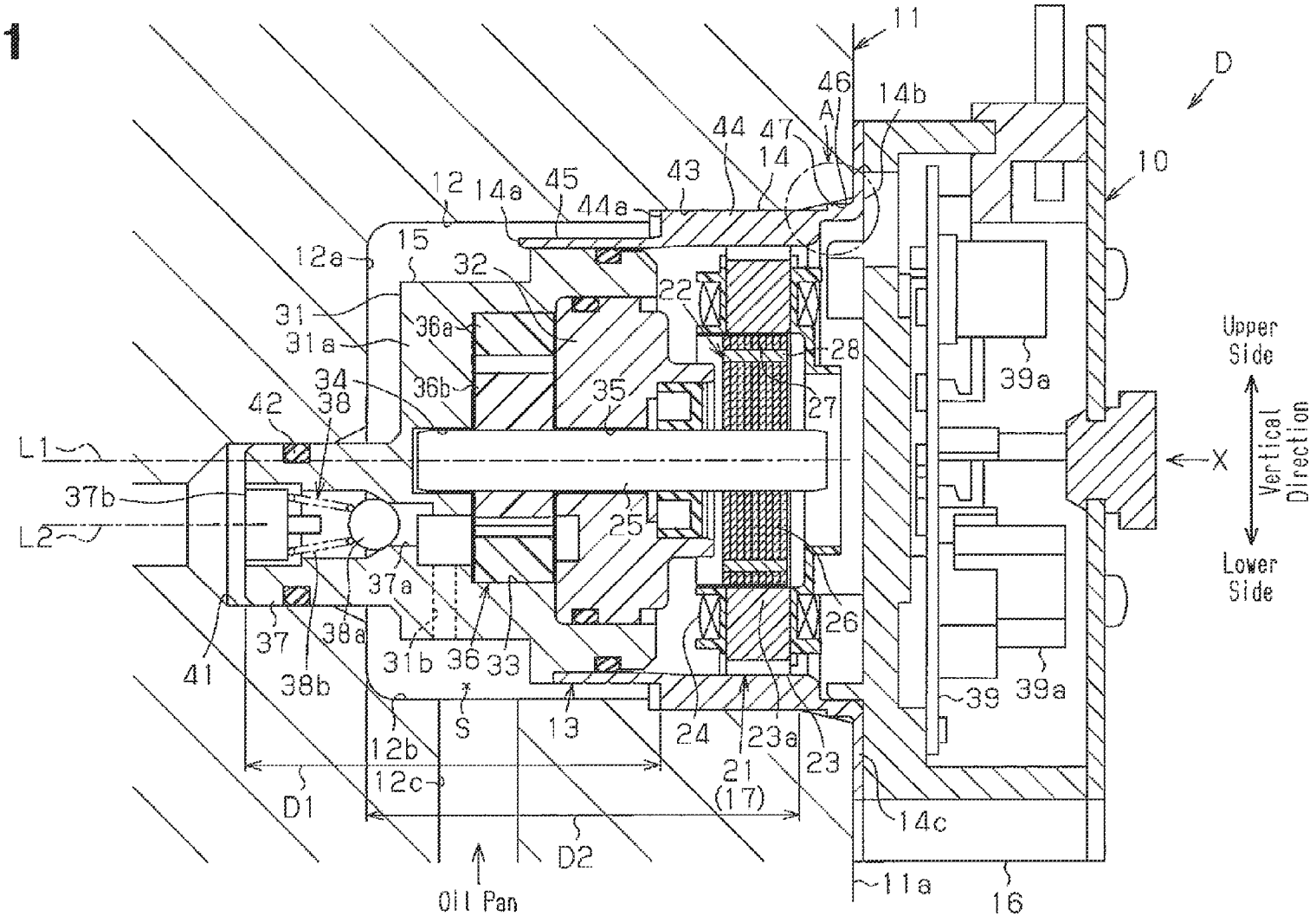
FIG. 1 is a cross-sectional view showing an electric oil pump according to one embodiment of the present invention coupled to a transmission.

Referring to FIG. 1, an electric oil pump 10 of the present invention is used for a transmission 11 (drive force transmission device) of a vehicle. The electric oil pump 10 is coupled to the transmission 11 so that the electric oil pump 10 is partially fitted in a pump receptacle 12, which is located in the transmission 11. The electric oil pump 10 and the pump receptacle 12 form a hydraulic pressure supply device D of the transmission 11.

The electric oil pump 10 includes a housing 13. The housing 13 includes a tubular motor case 14, a pump case 15 arranged in one axial end (first end 14*a*) of the motor case 14, and a circuit case 16 arranged in the other axial end (second end) of the motor case 14. The portion of the electric oil pump 10 received in the pump receptacle 12 forms a portion of the housing 13 (fitted portion). In the present embodiment, the fitted portion includes the entire pump case 15 and a portion of the motor case 14. The housing 13 is formed to close the pump receptacle 12.

The motor case 14 is formed from a metal material (preferably steel) and set so that its axis L1 extends parallel to the horizontal direction. Further, the motor case 14 accommodates a motor 17, which serves as a drive source for the electric oil pump 10. The motor 17 includes an annular stator 21, which is fixed to an inner surface of the motor case 14, and a motor rotor 22, which is located at the inner side of the motor stator 21.

The motor stator 21 includes a stator core 23, which is formed by electromagnetic steel plates stacked in the axial direction. The stator core 23 includes teeth 23*a*, which extend toward the inner side in the radial direction. A coil 24 is wound around each tooth 23*a*. The outer surface of the stator core 23 is in metal contact with the inner surface of the motor case 14. The axis of the motor stator 21 conforms to the axis L1 of the motor case 14. The coils 24 are located in slots formed between adjacent teeth 23*a* in the circumferential direction.

The motor rotor 22 includes a cylindrical rotor core 26 (main rotor body) that is fitted onto and fixed to a rotation shaft 25. The rotor core 26 is formed by stacking electromagnetic steel plates in the axial direction. The rotation shaft 25 is formed from stainless steel, which is a non-magnetic metal. The axis of the rotation shaft 25 conforms to the axis L1 of the motor case 14.

Figure 2:
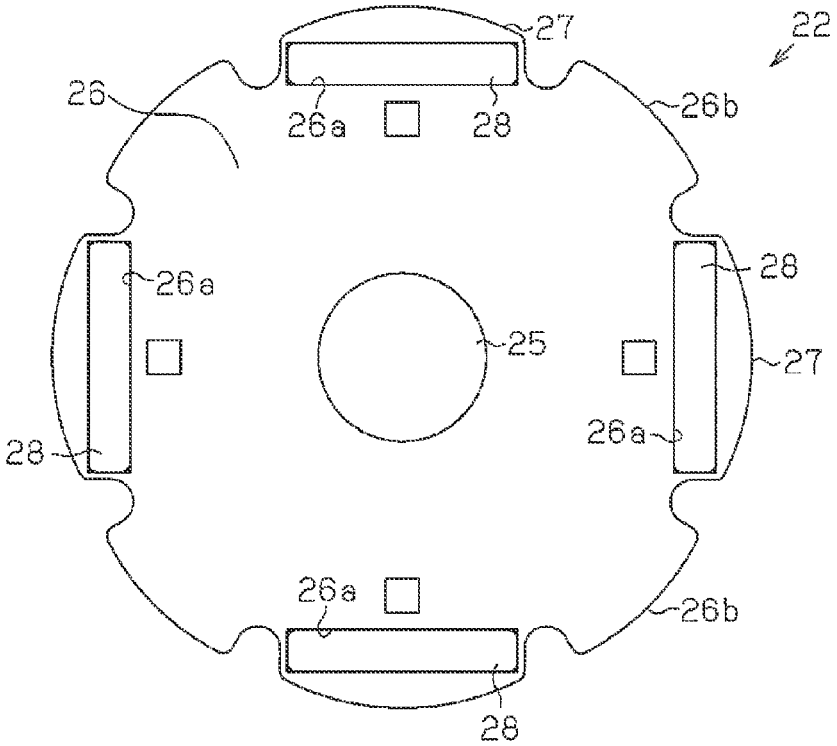
FIG. 2 is a plan view of a motor rotor shown in FIG. 1.

Referring to FIG. 2, a peripheral portion of the rotor core 26 includes a plurality of (four in the present embodiment) magnetic poles 27 formed at equal intervals in the circumferential direction opposing the teeth 23*a* in the radial direction. Each magnetic pole 27 is formed by embedding a plate-shaped magnet 28 in the peripheral portion of the rotor core 26. The motor rotor 22 of the present embodiment is of an interior permanent magnet (IPM) type.

In detail, the peripheral portion of the rotor core 26 includes magnet sockets 26*a* arranged at equal intervals (90-degree intervals) in the circumferential direction. Each magnet socket 26*a* extends in the axial direction of the rotor core 26. One of the magnets 28 is held in and fixed to each magnet socket 26*a* in a direction orthogonal to the radial direction of the rotor core 26 to form the magnetic pole 27. The magnets 28 are arranged so that the outer magnetic surfaces in the radial direction of the rotor core 26 (magnetic pole 27) all have the same polarity (e.g., S pole). Thus, in the motor rotor 22, the four magnetic poles 27, which have the same polarity (S pole), are formed at generally equal intervals (intervals of approximately 90 degrees) in the circumferential direction. A steel projection 26*b* extends toward the outer side in the radial direction from the rotor core 26 between adjacent magnetic poles 27 in the circumferential direction. The magnetic effect of each magnet 28 forms a salient pole in the corresponding steel projection 26*b* having a polarity that differs from the adjacent magnetic poles 27. In this manner, the motor rotor 22 is of the so-called consequent pole type rotor.

The number of slots of the motor stator 21 (number of teeth 23*a*) is an integral multiple of the number of magnetic poles 27. In the present embodiment, there are four magnetic poles 27. Thus, the number of slots between the teeth 23*a* is set to be an integer multiple of four. As a result, when a certain magnetic pole 27 is opposed to a tooth 23*a*, each magnetic pole 27 at the other locations is also opposed to a tooth 23*a*. This allows for reduction in biased load applied in the radial direction to the motor rotor 22.

The pump case 15 includes a main body 31, which is coupled to the first end 14*a* of the motor case 14, and a lid 32, which is coupled to the main body 31. The main body 31 and the lid 32 are both formed from aluminum, which is a non-magnetic metal. The main body 31 is fitted into and fixed to the open first end 14*a* of the motor case 14. A pump chamber 33 is defined in the main body 31. The pump chamber 33 is hermetically sealed by the lid 32, which is coupled to the main body 31 from a location near the motor 17 in the axial direction.

The pump case 15 supports the rotation shaft 25 with a shaft seat 34 (second shaft support), which is formed by a recess in the pump chamber 33, and a shaft hole 35 (first shaft support), which extends through the lid 32. The shaft hole 35 (lid 32) is located in the pump chamber 33 proximal to the motor 17, and the shaft seat 34 is located in the pump chamber 33 distal from the motor 17 and near a boss 37, which will be described later. A pump rotor 36 (pumping portion), which is coupled to the rotation shaft 25, is arranged in the pump chamber 33.

Figure 3:
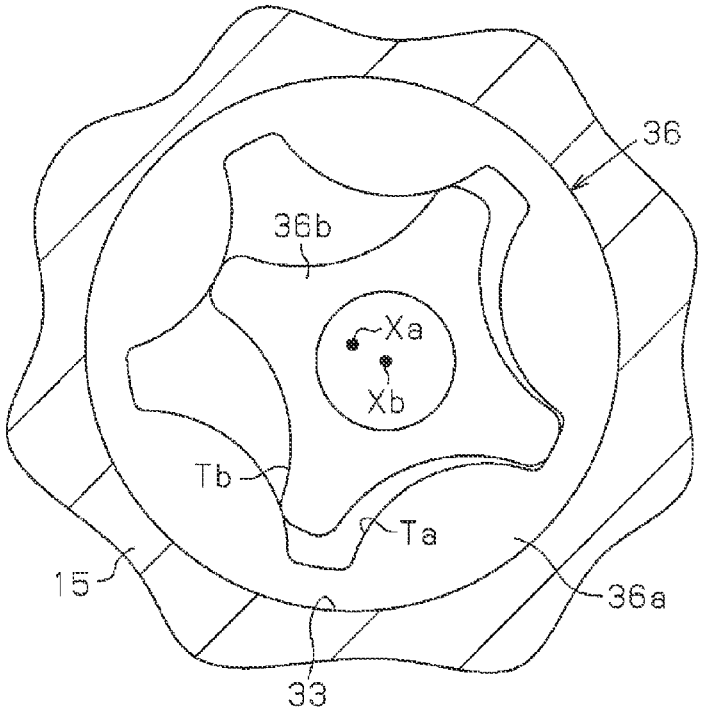
FIG. 3 is a schematic diagram illustrating a pump rotor shown in FIG. 1.

Referring to FIG. 3, the pump rotor 36 is of an inscribed gear type and includes an outer rotor portion 36*a* and an inner rotor portion 36*b*. The outer rotor portion 36*a* includes an n number of teeth, where n is a natural number of three or greater. The inner rotor portion 36*b* includes an n−1 number of teeth and is fixed to the rotation shaft 25 near one end of the rotation shaft 25.

In detail, the inner rotor portion 36*b* includes four outer teeth Tb, and the outer rotor portion 36*a* includes five inner teeth (grooves) Ta, which are engaged with the outer teeth Tb. The outer rotor portion 36*a* is configured to rotate about an axis Xa while moving along the inner surface of the pump chamber 33. The axis Xa is separated from the axis Xb of the inner rotor (rotation shaft 25).

In the present embodiment, the inner rotor portion 36*b* and the outer rotor portion 36*a* are formed from an engineering plastic, which is a resin material having superior heat resistance, durability, and mechanical properties (wear resistance and impact strength). To increase the strength, carbon fiber or glass fiber is mixed in the engineering plating forming the inner rotor portion 36*b* and the outer rotor portion 36*a*. Examples of an engineering plastic are, for example, polyimide material and polyamide material.

Referring to FIG. 1, the main body 31 of the pump case 15 includes an end wall 31*a* that is exposed from the motor case 14. The boss 37 (discharge port) projects from the end wall 31*a* in the axial direction of the motor case 14. The boss 37 includes an interior that is in communication with the pump chamber 33. The axis L2 of the boss 37 is separated from the axis of the motor case 14. A check valve 38, which prevents the oil in an outflow passage 41 from entering the pump chamber 33, is accommodated in the interior of the boss 37.

The check valve 38 includes a ball 38*a* and a compression coil spring 38*b*. The ball 38*a* is capable of closing a narrow portion 37*a* in the boss 37. The compression coil spring 38*b* urges the ball 38*a* toward the narrow portion 37*a*. When the pump rotor 36 is not driven, the ball 38*a* closes the narrow portion 37*a*. When the pump rotor 36 is driven, the ball 38*a* is separated from the narrow portion 37*a* against the spring pressure by the hydraulic force produced by the pump rotor 36. This allows for oil to flow through the boss 37. It is desirable that the ball 38*a* and the compression coil spring 38*b* be formed from a metal or resin material that is heat resistant.

The main body 31 of the pump case 15 has a peripheral portion including a suction port 31*b* that connects an oil compartment S, which is defined between the pump case 15 and the pump receptacle 12, and the pump chamber 33. The suction port 31*b* extends downward in the vertical direction (direction orthogonal to the axis L1) from the pump chamber 33 and opens in the lower outer surface of the main body 31.

A flange 14*c* extends toward the outer side in the radial direction from the entire circumference of the second end 14*b* of the motor case 14. The flange 14*c* contacts an end surface, or fixing surface 11*a*, of the transmission 11 where the pump receptacle 12 is formed in a coupling direction X (direction parallel to the axis L1 of the motor case 14). The circuit case 16, which accommodates a circuit board 39, closes the second end 14*b* of the motor case 14. Circuit elements 39*a* are mounted on the circuit board 39. The circuit case 16 and the flange 14*c* of the motor case 14 are fastened to the fixing surface 11*a* of the transmission by screws (not shown).

The pump receptacle 12 of the transmission 11 is circular as viewed in the coupling direction X. Further, the pump receptacle 12 is stepped so that portions closer to an open end in the fixing surface 11*a* have larger diameters. An end surface 12*a* of the pump receptacle 12 includes a round oil outflow passage 41, which serves as an engaged portion. The boss 37, which serves as a circumferential direction positioning portion of the pump case 15, is fitted into the oil outflow passage 41. Thus, a discharge port 37*b*, which is formed in the distal end of the boss 37, is located in the oil outflow passage 41. A seal 42 hermetically seals the gap between the wall surface of the oil outflow passage 41 and the outer surface of the boss 37.

An oil inflow passage 12*c* is formed in the lower side of the wall surface 12*b* of the pump receptacle 12 at a position closer to the end surface 12*a* than a fitting recess 43. The oil inflow passage 12*c* draws oil into the pump receptacle 12 from an oil pan.

The circular fitting recess 43 is formed in a portion of the pump receptacle 12 near the open end. An axis alignment fitting portion 44 of the motor case 14 is fitted into the fitting recess 43. The outer surface of the axis alignment fitting portion 44 is round and extends around the axis L1 of the motor case 14. When the axis alignment fitting portion 44 is fitted into the fitting recess 43, the axis of the housing 13 conforms to the axis of the pump receptacle 12.

Figure 4:
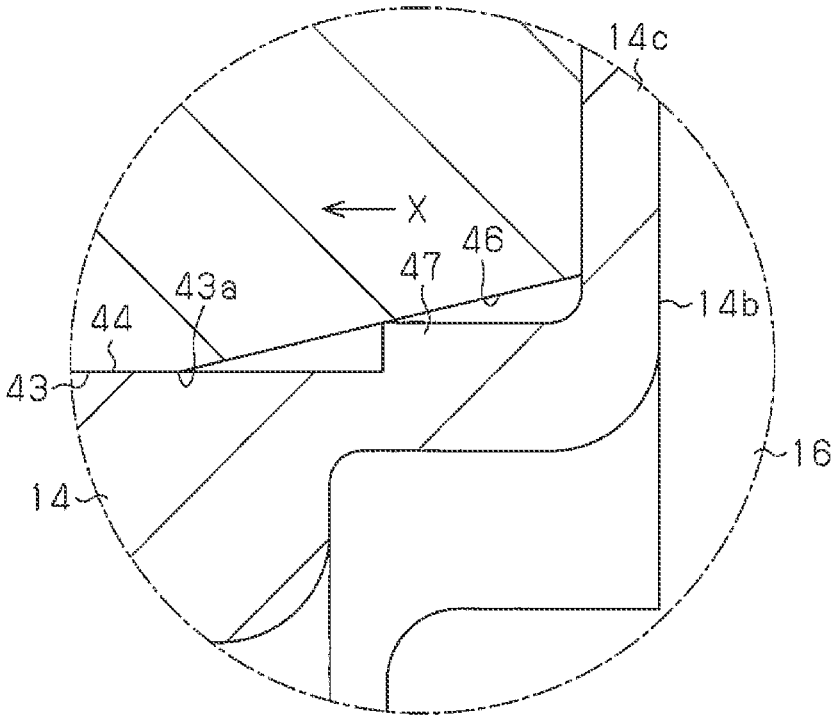
FIG. 4 is an enlarged view of region A shown in FIG. 1.

As shown in FIGS. 1 and 4, a tapered portion 46 is formed in the entire circumference of an open end portion of the pump receptacle 12 in the fixing surface 11*a*. The diameter of the tapered portion 46 increases at locations closer to the fixing surface 11*a*. The smaller side of the tapered portion 46 is continuous with the fitting recess 43.

The motor case 14 includes a sealing portion 47 located between the flange 14*c* and the axis alignment fitting portion 44. The sealing portion 47 is formed integrally with the motor case 14 to project toward the outer side in the radial direction from the outer surface of the motor case 14. The diameter of the sealing portion 47 is larger than the diameter of the axis alignment fitting portion 44. The sealing portion 47 is pressed against the tapered portion 46 in the coupling direction X. Thus, the motor case 14 hermetically seals the open end portion of the pump receptacle 12.

In the motor case 14, the portion between a distal end 44*a* (fitting end) of the axis alignment fitting portion 44 and the first end 14*a* defines a small diameter portion 45, which has a smaller diameter than the axis alignment fitting portion 44. A gap is formed between the small diameter portion 45 and the wall surface 12*b* of the pump receptacle 12.

The oil compartment S in the pump receptacle 12 extends between the wall surface 12*b* of the pump receptacle 12 and the outer surfaces of the small diameter portion 45 and the main body 31 (pump case 15) of the motor case 14 in the radial direction and from the end wall 31*a* of the main body 31 to the end surface 12*a* of the pump receptacle 12 in the axial direction. Oil is allowed to flow into the oil compartment S from the oil inflow passage 12*c*.

A method for coupling the electric oil pump 10 to the transmission will now be described.

First, the boss 37 of the electric oil pump 10 is fitted into the pump receptacle 12 in the axial direction (direction of axis L1). The axis alignment fitting portion 44 of the motor case 14 is fitted into the fitting recess 43 in the coupling direction X. This aligns the axis of the housing 13 with the axis of the pump receptacle 12 and positions the motor case 14 in the radial direction.

Referring to FIG. 1, the length D1 from the distal end 44*a* (fitting end) of the axis alignment fitting portion 44 to the distal end of the boss 37 in the coupling direction X of the electric oil pump 10 is less than the length D2 from an inlet end 43*a* of the fitting recess 43 (boundary of fitting recess 43 and tapered portion 46) to the open end of the outflow passage 41 (end surface 12*a* of pump receptacle 12). Thus, when the distal end 44*a* of the axis alignment fitting portion 44 is close to the inlet end 43*a* of the fitting recess 43, the boss 37 is still not at the open end of the outflow passage 41. As a result, when the axis alignment fitting portion 44 is fitted into the fitting recess 43, the motor case 14 may be rotated in contact with the fitting recess 43 to align the boss 37 with the outflow passage 41. This allows for the boss 37 to be fitted into the outflow passage 41 in the coupling direction X. When the boss 37 is fitted into the outflow passage 41, the electric oil pump 10 is positioned in the circumferential direction.

Then, the motor case 14 is further fitted into the pump receptacle 12 in the coupling direction X until the flange 14*c* contacts the fixing surface 11*a*. Screws, not shown, are used to fasten and fix the flange 14*c* and the circuit case 16 to the fixing surface 11*a*. This completes the coupling of the electric oil pump 10 to the pump receptacle 12.

The operation of the present embodiment will now be described.

In the electric oil pump 10, the coils 24 of the motor stator 21 are excited to rotate the motor rotor 22, the rotation shaft 25, and the inner rotor portion 36*b*. The engagement of the inner teeth Ta and the outer teeth Tb rotates the outer rotor portion 36*a*. As a result, the rotation of the inner rotor portion 36*b* and the outer rotor portion 36*a* produces a pumping effect that draws oil from the oil compartment S through the suction port 31*b* and into the pump chamber 33. Further, oil is discharged from the discharge port 37*b* in the boss 37 into the oil outflow passage 41. In the hydraulic pressure supplying device D of the present embodiment, an oil flow passage through which oil flows is defined by, from the upstream side (oil pan side), the oil inflow passage 12*c*, the coil compartment S, the suction port 31*b*, the pump chamber 33, the boss 37, and the oil outflow passage 41.

Since the inner rotor portion 36*b* and the outer rotor portion 36*a* are formed from a resin material (engineering plastic) in the present embodiment, the weight may be decreased as compared to, for example, a metal material. Further, resin materials have superior buffering (elastic) characteristics compared to metal material. This dampens pinging noise produced by the inner rotor portion 36*b* and the outer rotor portion 36*a* and pinging noise of the outer rotor portion 36*a* and the wall surface of the pump chamber 33. Moreover, resin materials have superior corrosion resistance and are easier to mold as compared with metal materials.

However, resin materials are inferior to metal materials in heat resistance, durability, and mechanical properties (wear resistance and impact strength). To compensate for such disadvantages, engineering plastic that has superior heat resistance, wear resistance, and mechanical properties is used as the resin material for the inner rotor portion 36*b* and the outer rotor portion 36*a*. Further, in the present embodiment, carbon fibers or glass fibers are mixed in the engineering plastic to increase the strength of the inner rotor portion 36*b* and the outer rotor portion 36*a*.

Additionally, when forming the inner rotor portion 36*b* and the outer rotor portion 36*a* from a resin material, thermal expansion or thermal contraction results in outstanding changes in the tip clearance (radial gap) between the outer teeth Tb and the inner teeth Ta. More specifically, the tip clearance increases when the temperature is low and decreases when the temperature is high. When the temperature is low, the oil is increased in viscosity and resists flow. However, the low temperature increases the tip clearance and decreases the planar pressure between the outer teeth Tb and the inner teeth Ta. This allows for the power consumption of the motor 17 to be decreased (i.e., reduction in size of the motor 17). In contrast, when the temperature is high, the viscosity of the oil decreases. Thus, if the tip clearance were large, the pumping efficiency (volumetric efficiency) would greatly decrease. However, the high temperature decreases the tip clearance. Thus, even when the high temperature decreases the oil viscosity, the decrease in the pumping efficiency is limited.

Outstanding changes in the tip clearance between the inner rotor portion 36*b* and the outer rotor portion may move the axes of the inner rotor portion 36*b*, the outer rotor portion 36*a*, and the motor rotor 22. In this regard, in the present embodiment, the motor rotor 22 is of an interior permanent magnet type. Thus, even if the movement of an axis results in the rotor core 26 and the motor stator 21 interfering with each other, direct contact of the magnets 28 with the motor stator 21 is prevented.

Further, in the present embodiment, the motor rotor 22 is of a consequent pole type. The steel projections 26*b* of the motor rotor 22 function as magnetic poles but are actually salient poles that differ from real magnets. Thus, magnets having a polarity that differs from that of the magnets 28 are not located proximal to the magnets 28. This allows for magnetic flux to easily flow to portions other than the steel projections 26*b*. In this respect, the pump rotor 36 (inner rotor portion 36*b* and outer rotor portion 36*a*) of the present embodiment is formed from a resin material. This limits magnetization of the pump rotor 36 caused by flux leakage. Thus, there is no magnetic force that attracts steel chips or the like to the pump rotor 36, and operations are not impeded by steel chips entering gaps between the inner rotor portion 36*b* and the outer rotor portion 36*a* and gaps between the outer rotor portion 36*a* and the wall surface of the pump chamber 33.

When the motor 17 is driven, the rotation of the pump rotor 36 (pumping action) draws oil into the oil compartment S from the oil pan through the oil inflow passage 12*c*. When the surface level of the oil collected in the oil compartment S reaches at least the inlet of the suction port 31*b* (lower end of the suction port 31*b* in the present embodiment), the oil flows into the pump chamber 33 from the suction port 31*b* and is discharged from the discharge port 37*b* into the oil outflow passage 41. In this manner, oil remains collected in the oil compartment S while being delivered from the oil inflow passage 12*c* to the oil outflow passage 41.

When the motor 17 is not driven, oil does not flow into the oil compartment S from the oil pan. This may lower the surface level of the oil in the oil compartment S. In the present embodiment, the check valve 38 in the boss 37 limits the oil released into the oil inflow passage 12*c* (oil pan side) from the oil compartment S. In detail, when the motor 17 is not driven, the check valve 38 closes the flow passage (narrow portion 37*a*) in the boss 37 and limits the flow of air into the pump chamber 33 from the oil outflow passage 41. This limits the flow of oil out of the oil compartment S and limits the falling of the surface level of the oil in the oil compartment S. Thus, when the motor 17 is not driven, oil remains collected in the oil compartment S.

As described above, oil is stored in the oil compartment regardless of whether or not the motor 17 is driven. Further, the pump case 15 and the motor case 14 are partially immersed in the oil that is stored in the oil compartment S. Thus, the oil, which generally has a higher heat conductance than air, exchanges heat between the electric oil pump 10, especially, the motor stator 21, and the transmission 11.

When initially operating the electric oil pump 10 after coupling the electric oil pump 10 to the pump receptacle 12, there is no oil in the oil compartment S. Thus, the pump rotor 36 is rotated without oil in the pump chamber 33 until oil enters the oil compartment S, that is, until the surface level of the oil flowing from the oil inflow passage 12*c* into the oil compartment S rises to the suction port 31*b*. In the present embodiment, the suction port 31*b* is located at the lower side of the pump rotor 36 and opens downward. This shortens the time during which the surface level of the oil in the oil compartment S reaches the inlet of the suction port 31*b*. Thus, the time is shortened during which the pump rotor 36 is rotated when there is no oil. As a result, friction is reduced between the pump rotor 36 and the pump case 15. This reduces wear of the pump rotor 36.

Further, in the present embodiment, the check valve 38 is located in the pump case 15 at a portion (downstream side of flow passage) closer to the discharge port 37*b* than the pump rotor 36 (pump chamber 33). This limits the entrance of air into the pump chamber 33 through the discharge port 37*b* from the oil outflow passage 41. As a result, the corrosion of internal components (e.g., rotation shaft 25) caused by moisture in the air is limited.

The present embodiment has the advantages described below.

(1) The oil compartment S, which receives oil from the oil inflow passage 12*c* when the pump rotor 36 rotates, is formed between a wall surface of the pump receptacle 12 and the outer surface of the housing 13 (motor case 14 and pump case 15). A portion (fitted portion) of the housing 13 in the oil compartment S is immersed in the collected oil. Further, the pump case 15 includes the check valve 38, which limits reversed flow of oil from the coil compartment S to the oil inflow passage 12*c*. In this structure, the housing 13 is partially immersed in the oil of the oil compartment S. This allows for the oil, which generally has a higher heat conductance than air, to radiate heat from the housing 13 (in particular, the motor 17). Further, when the pump rotor 36 stops rotating, the check valve 38 limits reversed flow of oil from the oil compartment S to the oil inflow passage 12*c*. This avoids a situation in which a decrease in the oil of the oil compartment adversely affects the heat radiation properties.

(2) The check valve 38 is arranged in the housing 13 closer to the discharge port 37*b* than the pump rotor 36. This limits the flow of air into the pump chamber 33 from the oil outflow passage 41 through the discharge port 37*b*. Consequently, the corrosion of internal components, such as the rotation shaft 25, caused by moisture in the air is limited.

(3) The open end (inlet end) of the suction port 31*b* is located at the lower side of the pump rotor 36 (pump chamber 33). Thus, if the electric oil pump 10 is operated when there is no oil in the oil compartment S, the surface level of the oil in the oil compartment S may be raised to the suction port 31*b* within a shorter period of time. This reduces the time during which the pump rotor 36 is rotated without oil and limits wear of the pump rotor 36 that would shorten the life of the pump rotor 36.

(4) The housing 13 includes the boss 37 projecting in the axial direction. The distal end of the boss 37 includes the discharge port 37*b*. The boss 37 is fitted into the oil outflow passage 41. This facilitates the alignment of the discharge port 37*b* of the electric oil pump 10 and the oil outflow passage 41 of the transmission 11 and improves the coupling efficiency.

(5) The check valve 38 is arranged in the boss 37. Thus, the axial length of the housing 13 in the pump receptacle 12 (length excluding the portion fitted into the oil outflow passage 41) does not have to be increased even though space for arrangement of the check valve 38 is obtained in the discharge port 37*b* of the pump rotor 36.

(6) The check valve 38 includes the ball 38*a* and the compression coil spring 38*b*. Thus, the check valve 38 may be formed by a small number of components.

(7) The check valve 38 includes metal components. Thus, high temperature does not adversely affect the check valve 38.

(8) The inner rotor portion 36*b* and the outer rotor portion 36*a* of the pump rotor 36 are formed from a resin material. This limits corrosion of the inner rotor portion 36*b* and the outer rotor portion 36*a*. Further, the electric oil pump 10 may be reduced in weight. Since the inner rotor portion 36*b* and the outer rotor portion 36*a* are formed from a resin material, thermal expansion or thermal contraction results in outstanding changes in the tip clearance between the outer teeth Tb and the inner teeth Ta. This may move the axes of the inner rotor portion 36*b*, the outer rotor portion 36*a*, and the motor rotor 22. In this regard, in the present embodiment, the motor rotor 22 is of an interior permanent magnet type. Thus, even if the movement of an axis results in the rotor core 26 and the motor stator 21 interfering with each other, direct contact of the magnets 28 with the motor stator 21 is prevented. This limits damage and separation of the magnets 28.

In the present embodiment, the inner rotor portion 36*b* and the outer rotor portion 36*a* are both formed from a resin material. Thus, changes in the tip clearance (i.e., axis movement) become further outstanding. In this respect, by using the interior permanent magnet type motor rotor 22, the effects for limiting damage to the magnets 28 become further prominent.

(9) The motor rotor 22 is of a consequent pole type. The magnets 28 having the same polarity are embedded in the rotor core 26, which is formed by a magnetic body, in the circumferential direction, to form the magnetic poles 27. The steel projections 26*b* of the motor rotor 22 located between adjacent magnetic poles 27 function as poles having the other polarity. This structure allows for reduction in the number of magnets 28 of the motor rotor 22. Consequently, damage of the magnets 28 is further limited, and costs may be reduced.

(10) The number of slots of the motor stator 21, that is, the number of teeth 23*a*, is set as an integral multiple of the number of magnetic poles 27. As a result, when a certain magnetic pole 27 is opposed to a tooth 23*a*, each magnetic pole 27 at the other locations is also opposed to a tooth 23*a*. This allows for reduction in biased load applied in the radial direction to the motor rotor 22 and thereby decreases vibration of the motor rotor 22.

(11) The pump case 15 includes the shaft hole 35 and the shaft seat 34. The shaft hole 35 supports the rotation shaft 25 between the inner rotor portion 36*b* and the motor rotor 22, which are fixed to the rotation shaft 25 to rotate integrally with the rotation shaft 25. The shaft seat 34 supports the rotation shaft 25 at a location farther from the motor 17 than the inner rotor portion 36*b* and near the boss 37. In this structure, the inner rotor portion 36*b*, which is where load is applied to, is supported from two axial sides by the shaft seat 34 and the shaft hole 35. This limits movement of the axis of the motor rotor 22 (rotation shaft 25). Consequently, interference is limited between the rotor core 26 and the motor stator 21, and damage to the motor rotor 22 and the magnets 28 is further limited.

(12) Engineering plastic, which has superior heat resistance, durability, and mechanical properties (wear resistance and impact strength), is used as the resin material forming the inner rotor portion 36*b* and the outer rotor portion 36*a*. This improves the quality of the electric oil pump 10.

(13) Carbon fibers or glass fibers are mixed in the resin material (engineering plastic) of the inner rotor portion 36*b* and the outer rotor portion 36*a*. This increases the strength of the inner rotor portion 36*b* and the outer rotor portion 36*a*.

(14) The check valve 38 is arranged in the housing 13 of the electric oil pump 10. This improves the freedom of design for the pump receptacle 12 (transmission 11).

(15) The length D1 from the distal end 44*a* of the axis alignment fitting portion 44 to the distal end of the boss 37 in the coupling direction X of the electric oil pump 10 is less than the length D2 from the inlet end 43*a* of the fitting recess 43 to the open end of the outflow passage 41. In this structure, when the axis alignment fitting portion 44 is fitted into the fitting recess 43, that is, when the axes of the housing 13 and the pump receptacle 12 are aligned, the motor case 14 may be rotated in the circumferential direction until the boss 37 is aligned with the outflow passage 41. This facilitates the alignment of the boss 37 and the outflow passage 41 in the circumferential direction and improves the coupling efficiency of the electric oil pump 10.

(16) The motor case 14 includes the flange 14*c*, which contacts the fixing surface 11*a* in the coupling direction around the pump receptacle 12 and is fixed to the fixing surface 11*a*. This structure allows for the flange 14*c*, which is located outside the pump receptacle 12, to be fixed to the motor case 14, and facilitate the fastening of the motor case 14.

(17) The open end portion of the pump receptacle 12 includes the tapered portion 46, the diameter of which increases at locations closer to an open end (fixing surface 11*a*) of the open end portion. The motor case 14 includes the sealing portion 47, which is pressed against the tapered portion 46 in the coupling direction X to seal the open end of the pump receptacle 12. In this structure, the sealing portion 47 limits oil leakage from the open end of the pump receptacle 12.

(18) The motor case 14 and the pump case 15 of the housing 13 are formed from a metal material. Thus, heat is transmitted from the electric oil pump 10, particularly, the motor stator 21, to the transmission 11 in a desirable manner. This improves the heat radiation efficiency of the electric oil pump 10.

(19) The boss 37 and the outflow passage 41, into which the boss 37 is fitted, position the electric oil pump 10 in the circumferential direction. Thus, there is no need for a separate structure used for positioning in the circumferential direction. As a result, the structures of the electric oil pump 10 and the transmission 11 may be simplified.

(20) The diameter of the motor case 14 is set to decrease at locations closer to the first end 14*a* in the axial direction (distal side relative to the coupling direction X). This facilitates removal of a mold when molding the motor case 14 and allows for easy manufacturing.

It should be apparent to those skilled in the art that the present invention may be embodied in many other specific forms without departing from the spirit or scope of the invention. Particularly, it should be understood that the present invention may be embodied in the following forms.

The shape and structure of the pump case 15 is not limited to the foregoing description and may be changed.

For example, in the above embodiment, the inlet end of the suction port 31*b* does not have to be formed in the lower surface of the main body 31 of the pump case 15. For example, the suction port 31*b* may be formed at the same level as the pump chamber 33 in the vertical direction or at a higher level than the pump chamber 33. Such a structure allows for the surface level of the oil to rise in the oil compartment S. This increases the area of the motor case 14 and the pump case 15 immersed in the oil. As a result, heat may be radiated from the motor case 14 and the pump case 15 through the oil in the oil compartment S in a desirable manner.

In the present embodiment, the check valve 38 does not have to be located at the downstream side of the pump chamber 33 near the discharge port 37*b*. For example, the check valve 38 may be located at the upstream side of the pump chamber 33 in, for example, the suction port 31*b*.

In the present embodiment, the boss 37, which includes the discharge port 37*b* at the distal end, does not have to be arranged on the pump case 15. For example, the boss 37 may be omitted, and the discharge port 37*b* may be formed in the end wall of the pump case 15.

In the above embodiment, the rotation shaft 25 is supported at the two axial sides of the pump rotor 36. In addition, the rotation shaft 25 may be supported at the two axial sides of the motor rotor 22.

In the above embodiment, the number of slots (teeth 23*a*) does not have to be set to be an integral multiple of the magnetic poles 27. The number of slots and the number of the magnetic poles 27 may be changed in accordance with the structure.

The pump rotor 36 includes the inner rotor portion 36*b* (outer teeth Tb), which has four teeth, and the outer rotor portion 36*a* (inner teeth Ta), which has five teeth. The number of teeth of the inner rotor portion 36*b* only needs to be one less than that of the outer rotor portion 36*a*. For example, the number of teeth of the inner rotor portion 36*b* may be six, and the number of teeth of the outer rotor portion 36*a* may be seven.

In the above embodiment, the inner rotor portion 36*b* and the outer rotor portion 36*a* does not have to be formed by engineering plastic including carbon fibers or glass fibers. For example, the inner rotor portion 36*b* and the outer rotor portion 36*a* does not have to include carbon fiber or glass fiber. Further, as the engineering plastic forming the inner rotor portion 36*b* and the outer rotor portion 36*a*, in addition to a polyimide material or a polyamide material, a polycarbonate material or a polyacetal material may be used.

In the above embodiment, the inner rotor portion 36*b* and the outer rotor portion 36*a* are both formed from resin material. Instead, only one of the inner rotor portion 36*b* and the outer rotor portion 36*a* may be formed from a resin material.

In the above embodiment, the rotation shaft 25 connects the inner rotor portion 36*b* and the motor rotor 22 so that the inner rotor portion 36*b* serves as a driving side of the pump rotor 36 (side coupled to the rotation shaft 25) and the outer rotor portion 36*a* serves as a driven side. Instead, an outer rotor portion may be arranged in the motor rotor 22 to serve as the driving side, and the inner rotor portion may be arranged at the inner side of the outer rotor portion to serve as the driven side.

In the above embodiment, the outer rotor portion 36*a* and the inner rotor portion 36*b* of the pump rotor 36 may be formed by helical gears in which the inner teeth Ta and the outer teeth Tb are helical. In this structure, the inner teeth Ta are engaged with the outer teeth Tb not only in the rotation direction but also in the axial direction. This limits movement of the axis of the pump rotor 36 and reduces the noise produced by the engagement of the inner teeth Ta and the outer teeth Tb.

In the above embodiment, each tooth 23*a* (slot) of the stator core 23 may be oblique relative to the axial direction and have a skew structure. This structure reduces cogging torque.

In the above embodiment, a portion of the housing 13, more specifically, the entire pump case 15 and a portion of the motor case 14 are accommodated in the pump receptacle 12. Instead, the entire electric oil pump may be accommodated in the pump receptacle.

Figure 5:
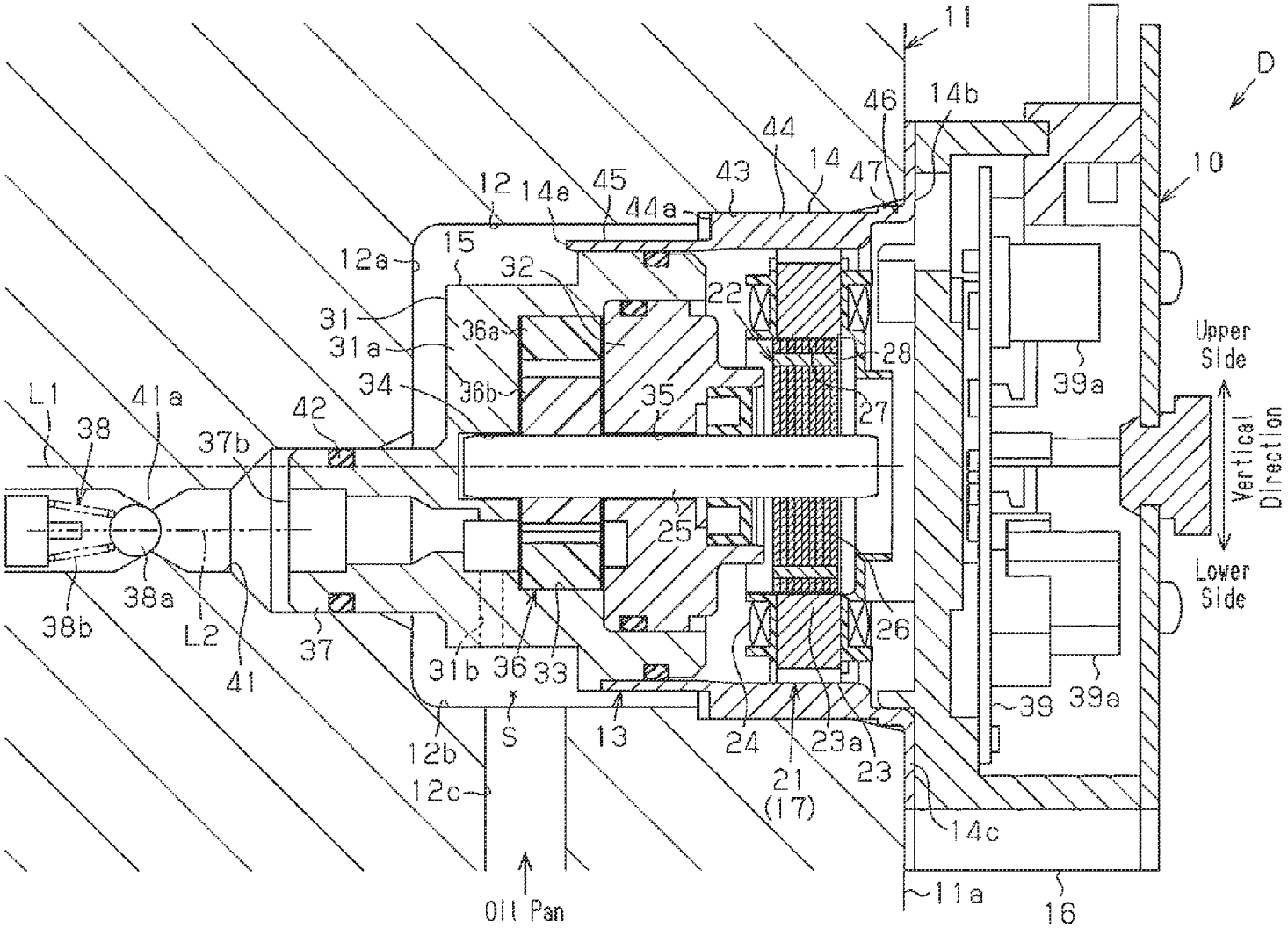
FIG. 5 is a cross-sectional view showing another example of a hydraulic pressure supply device.
Figure 6:
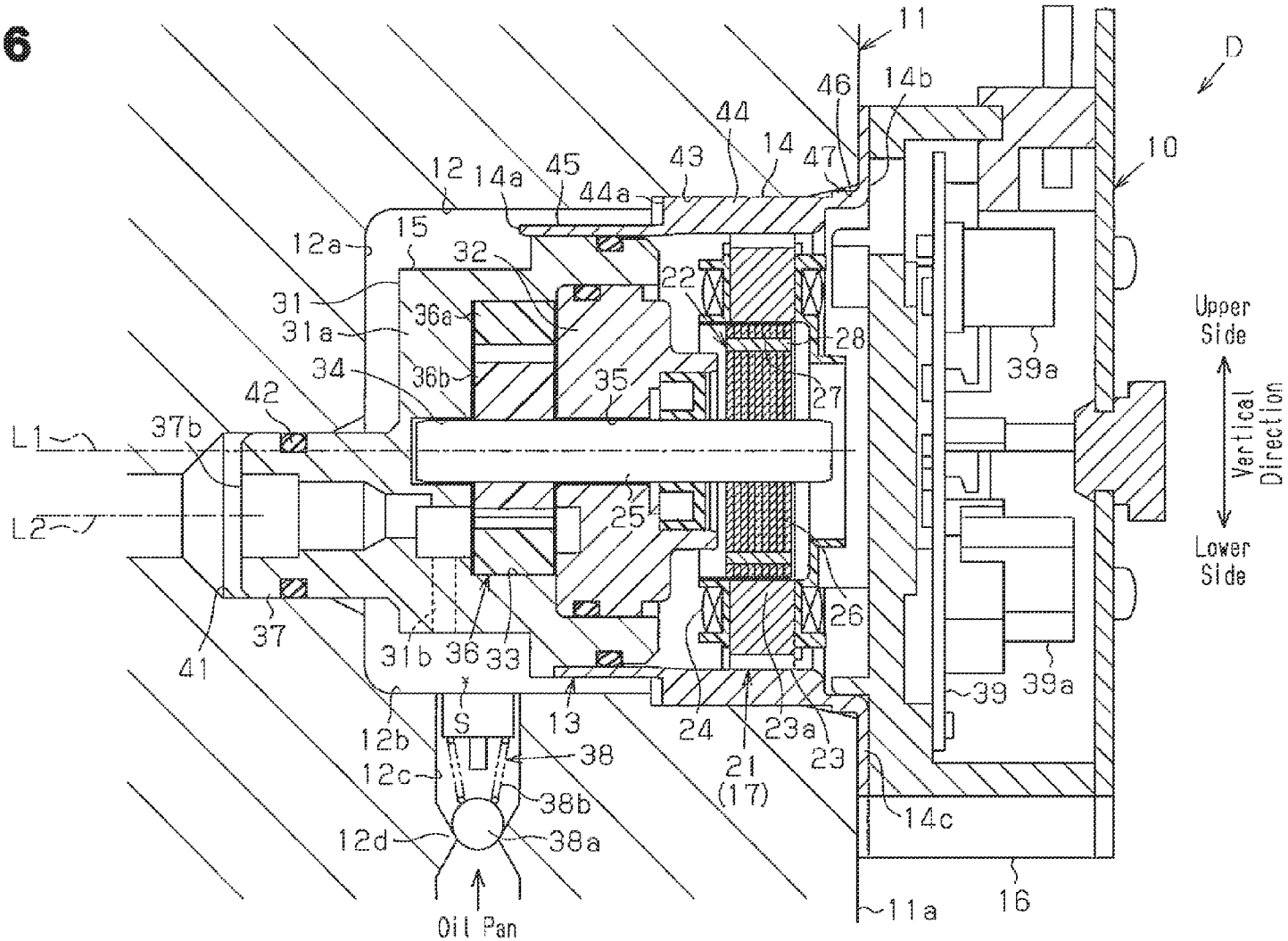
FIG. 6 is a cross-sectional view showing a further example of a hydraulic pressure supply device.

In the hydraulic pressure supply device D of the above embodiment, the check valve 38 is arranged in the boss 37 of the electric oil pump 10 that is in the oil flow passage through which oil flows. Instead, as shown in FIGS. 5 and 6, the check valve 38 may be arranged in the oil flow passage at a location other than the boss 37. In the hydraulic pressure supply device D, the oil flow passage is defined in order from the upstream side (oil pan side) by the oil inflow passage 12*c*, the coil compartment C, the suction port 31*b*, the pump chamber 33, the boss 37, and the oil outflow passage 41.

In FIG. 5, the check valve 38 is arranged in the oil outflow passage 41 of the pump receptacle 12 that is in the oil flow passage. The ball 38*a* of the check valve 38 is capable of closing a narrow portion 41*a* of the oil outflow passage 41 from the downstream side. The compression coil spring 38*b* urges the ball 38*a* toward the narrow portion 41*a* from the downstream side. When the pump rotor 36 is not driven, the ball 38*a* closes the narrow portion 41*a*. When the pump rotor 36 is driven, the hydraulic pressure generated by the pump rotor 36 separates the ball 38*a* from the narrow portion 41*a* against the spring force and allows oil to flow from the oil outflow passage 41.

In FIG. 6, the check valve 38 is arranged in the oil inflow passage 12*c* of the pump receptacle 12 that is in the oil flow passage. The ball 38*a* of the check valve 38 is capable of closing a narrow portion 12*d* of the oil inflow passage 12*c* from the downstream side. The compression coil spring 38*b* urges the ball 38*a* toward the narrow portion 12*d* from the downstream side. When the pump rotor 36 is not driven, the ball 38*a* closes the narrow portion 12*d*. When the pump rotor 36 is driven, the hydraulic pressure generated by the pump rotor 36 separates the ball 38*a* from the narrow portion 12*d* against the spring force and allows oil to flow from the oil inflow passage 12*c*.

Even if the check valve 38 is arranged in the oil outflow passage 41 or the oil inflow passage 12*c* as described above, the check valve 38 limits reversed flow of the oil from the oil compartment S to the oil inflow passage 12*c* when the pump rotor 36 stops operating. This limits decreases in the oil of the oil compartment S that would adversely affect the heat radiation properties. Further, the check valve 38 is arranged in the pump receptacle 12 (transmission 11). This improves the freedom of design for the housing 13 of the electric oil pump 10.

In the above embodiment, the boss 37 and the oil outflow passage 41 also serve as a circumferential direction positioning portion and an engaged portion. For example, the boss 37 may be formed so as not to project from the end wall 31*a* of the pump case 15 (main body 31). That is, the projection may be formed not to engage the outflow passage 41 in the circumferential direction. In this case, a circumferential direction positioning portion may be arranged in the pump receptacle 12 to position the electric oil pump 10 in the circumferential direction.

In the above embodiment, the sealing portion 47 does not have to be formed integrally with the motor case 14. For example, an O-ring formed from a resin material may be used as a sealing portion and be arranged between the outer surface of the motor case 14 and the tapered portion 46.

In the above embodiment, the motor case 14 and the pump case 15 do not have to be formed from metal. For example, either one of the motor case 14 and the pump case 15 may be formed from a resin material.

In the above embodiment, the pump rotor 36 does not have to be of an inscribed gear type. Any other pump rotor may be used as long as fluid may be drawn in and discharged.

The electric oil pump 10 does not have to be used for the transmission 11 of a vehicle and may be used, for example, in an engine to circulate oil. Further, the electric oil pump 10 may be used to circulate a fluid other than oil.

The present examples and embodiments are to be considered as illustrative and not restrictive, and the invention is not to be limited to the details given herein, but may be modified within the scope and equivalence of the appended claims.

The invention claimed is:

1. An electric oil pump coupled to a pump receptacle including an oil inflow passage and an oil outflow passage, the electric oil pump comprising:

a motor;

a pump rotor rotated when the motor is driven;

a housing that accommodates the motor and the pump rotor, wherein the housing is formed to close an opening of the pump receptacle and includes at least a fitted portion fitted into the pump receptacle, the housing includes an outer surface, and the pump receptacle includes a wall surface, an oil compartment is formed between the wall surface of the pump receptacle and the outer surface of the housing, oil flows into the oil compartment from the oil inflow passage when the pump rotor is rotated, the fitted portion is partially immersed in the oil collected in the oil compartment, and the housing includes a suction port through which oil is drawn into the housing from the oil compartment when the pump rotor rotates, a discharge port through which oil is discharged to the oil outflow passage when the pump rotor rotates;

an axis alignment fitting portion fitted into a circular fitting recess of the pump receptacle to align an axis of the housing with an axis of the pump receptacle, and a circumferential direction positioning portion located in the housing toward a distal side in a coupling direction from the axis alignment fitting portion, wherein the circumferential direction positioning portion is formed to be engageable with an engaged portion of the pump receptacle in a circumferential direction of the housing, and the circumferential direction positioning portion is formed to position the housing in the circumferential direction when engaging the engaged portion; and a check valve located in the housing, wherein the check valve limits reversed flow of the oil from the oil compartment to the oil inflow passage, wherein the suction port includes an open end located at a lower side of the pump rotor in a vertical direction the electric oil pump is coupled to the pump receptacle in the coupling direction;

the axis alignment fitting portion of the housing includes a fitting end in the coupling direction;

the circumferential direction positioning portion of the housing includes a distal end in the coupling direction; and a length from the fitting end of the axis alignment fitting portion to the distal end of the circumferential direction positioning portion is less than a length from an inlet end of the fitting recess to the engaged portion.

2. The electric oil pump according to claim 1, wherein the check valve is located between the discharge port and the pump rotor.

3. The electric oil pump according to claim 1, wherein the housing further includes a flange that contacts an end surface from which the pump receptacle extends in the coupling direction, and the flange is fixed to the end surface.

4. The electric oil pump according to claim 1, wherein the pump receptacle includes an open end portion, the open end portion includes a tapered portion in which the diameter increases at locations closer to an open end of the open end portion, and the housing further includes a sealing portion that is pressed against the tapered portion to seal the open end of the pump receptacle.

5. The electric oil pump according to claim 1, wherein the housing is formed from a metal material.

6. The electric oil pump according to claim 1, wherein the check valve includes a ball and a compression coil spring.

7. The electric oil pump according to claim 1, wherein the check valve includes a metal component.

8. The electric oil pump according to claim 1, wherein the circumferential direction positioning portion includes a boss projecting in an axial direction of the housing, the boss has a distal end including the discharge port, and the engaged portion includes the oil inflow passage into which the boss is fitted.

9. The electric oil pump according to claim 1, wherein the housing includes a boss that projects in an axial direction, the boss has a distal end that includes the discharge port, and the boss is fitted into the oil outflow passage.

10. The electric oil pump according to claim 9, wherein the check valve is located in the boss.

11. A hydraulic pressure supply device comprising:

a pump receptacle including an oil inflow passage and an oil outflow passage;

an electric oil pump coupled to the pump receptacle, wherein the electric oil pump includes a motor, a pump rotor rotated when the motor is driven, a housing that accommodates the motor and the pump rotor, wherein the housing is formed to close an opening of the pump receptacle and includes at least a fitted portion fitted into the pump receptacle, the housing includes an outer surface, and the pump receptacle includes a wall surface, an oil compartment is formed between the wall surface of the pump receptacle and the outer surface of the housing, oil flows into the oil compartment from the oil inflow passage when the pump rotor is rotated, the fitted portion is partially immersed in the oil collected in the oil compartment, and the housing includes a suction port through which oil is drawn into the housing from the oil compartment when the pump rotor of the electric oil pump rotates, and a discharge port through which oil is discharged to the oil outflow passage when the pump rotor rotates, an axis alignment fitting portion fitted into a circular fitting recess of the pump receptacle to align an axis of the housing with an axis of the pump receptacle, and a circumferential direction positioning portion located in the housing toward a distal side in a coupling direction from the axis alignment fitting portion, wherein the circumferential direction positioning portion is formed to be engageable with an engaged portion of the pump receptacle in a circumferential direction of the housing, and the circumferential direction positioning portion is formed to position the housing in the circumferential direction when engaging the engaged portion; and a check valve located in an oil flow passage including the oil inflow passage and the oil outflow passage, wherein the check valve limits reversed flow of the oil from the oil compartment to the oil inflow passage, wherein the suction port includes an open end located at a lower side of the pump rotor in a vertical direction the electric oil pump is coupled to the pump receptacle in the coupling direction;

the axis alignment fitting portion of the housing includes a fitting end in the coupling direction;

the circumferential direction positioning portion of the housing includes a distal end in the coupling direction; and a length from the fitting end of the axis alignment fitting portion to the distal end of the circumferential direction positioning portion is less than a length from an inlet end of the fitting recess to the engaged portion.

12. The hydraulic pressure supply device according to claim 11, wherein the check valve is located in the housing.

13. The hydraulic pressure supply device according to claim 11, wherein the check valve includes a ball and a compression coil spring.

14. The hydraulic pressure supply device according to claim 11, wherein the check valve includes a metal component.

* * * * *